US010143980B1

(12) United States Patent
Marko

(10) Patent No.: US 10,143,980 B1
(45) Date of Patent: Dec. 4, 2018

(54) POWER SHAKER BLENDER

(71) Applicant: Bruce Marko, Charlotte, NC (US)

(72) Inventor: Bruce Marko, Charlotte, NC (US)

( * ) Notice: Subject to any disclaimer, the term of this patent is extended or adjusted under 35 U.S.C. 154(b) by 159 days.

(21) Appl. No.: 15/390,401

(22) Filed: Dec. 23, 2016

(51) Int. Cl.

| | |
|---|---|
| ***B01F 7/00*** | (2006.01) |
| ***B01F 7/32*** | (2006.01) |
| ***B01F 7/20*** | (2006.01) |
| ***B01F 15/00*** | (2006.01) |

(52) U.S. Cl.
CPC ..... *B01F 7/20* (2013.01); *B01F 7/00033* (2013.01); *B01F 7/00291* (2013.01); *B01F 7/00316* (2013.01); *B01F 7/00325* (2013.01); *B01F 7/00583* (2013.01); *B01F 7/00733* (2013.01); *B01F 7/32* (2013.01); *B01F 15/00188* (2013.01); *B01F 15/00448* (2013.01); *B01F 15/00519* (2013.01); *B01F 15/00779* (2013.01); *B01F 15/00798* (2013.01); *B01F 15/00831* (2013.01); *B01F 2015/00597* (2013.01)

(58) Field of Classification Search
CPC .. B01F 7/20; B01F 15/00779; B01F 7/00325; B01F 7/00316; B01F 7/32; B01F 7/00033; B01F 7/00583; B01F 15/00831; B01F 15/00519; B01F 15/00448; B01F 15/00188; B01F 7/00291; B01F 7/00733; B01F 15/00798; B01F 2015/00597; A47J 31/4407; A47J 31/005
USPC ..... 366/129, 130, 343, 342, 325.94, 205
See application file for complete search history.

(56) References Cited

U.S. PATENT DOCUMENTS

| | | | | | |
|---|---|---|---|---|---|
| 177,888 | A * | 5/1876 | Rogers | B01F 13/002 | 366/343 |
| 308,901 | A * | 12/1884 | Kitchell | A23G 3/0215 | 366/325.7 |
| 1,025,798 | A * | 5/1912 | Fitch | B01F 13/002 | 366/343 |
| 1,518,418 | A * | 12/1924 | Streich | A21C 1/06 | 366/97 |
| 1,930,948 | A * | 10/1933 | Brewer | A47J 43/07 | 366/314 |
| 2,520,577 | A * | 8/1950 | Tooley | C03B 5/187 | 366/325.8 |
| 2,571,366 | A * | 10/1951 | Jennings | B01F 7/32 | 366/282 |
| 2,920,875 | A * | 1/1960 | Marfuggi | A47J 43/046 | 366/197 |
| 3,249,342 | A * | 5/1966 | Mikkelsen | B01F 7/00583 | 241/98 |

(Continued)

*Primary Examiner* — Tony G Soohoo
(74) *Attorney, Agent, or Firm* — Edwin D. Schindler

(57) ABSTRACT

A portable power shaker blender includes a mixing body is made of a high density polyethylene material, along with a base that includes a rechargeable battery and a motor. The blade assembly extends inwards into the interior of the mixing chamber and includes a central shaft with a pair of extending crossbars that terminate in a connecting pair of vertical members. An additional diagonal bar extends between a pair of the corners thus created. All of these bars are cylindrical in cross-section to encourage agitation. The cap of the power/shaker engages with the mixing body either through a friction fit or a screw top engagement, which includes a swivel top and a swivel top handle that is generally U-shaped and is able to receive a latching engagement, such as a latching or locking carabiner.

14 Claims, 8 Drawing Sheets

(56) References Cited

U.S. PATENT DOCUMENTS 3,627,008 A * 12/1971 Samuelian ..... A47J 43/046 215/320
3,704,007 A * 11/1972 Kroeger ..... B01F 13/002 366/248
4,091,457 A * 5/1978 Slywka ..... B01F 7/186 366/304
5,193,441 A * 3/1993 Hayashi ..... A47J 36/165 99/348
5,417,493 A * 5/1995 Ericson ..... B01F 7/00583 366/129
5,425,579 A * 6/1995 Sampson ..... B01F 7/162 366/130
5,636,923 A * 6/1997 Nejat-Bina ..... B01F 7/00908 241/74
5,639,161 A * 6/1997 Sirianni ..... B01F 7/162 366/205
5,692,830 A * 12/1997 Costanzo ..... A47J 43/00 366/199
5,720,552 A * 2/1998 Schindlegger ..... A47G 19/2205 366/197
D391,802 S * 3/1998 Wong ..... D7/378
D391,806 S * 3/1998 Khubani ..... D7/412
5,855,431 A * 1/1999 Costanzo ..... A47J 43/00 366/199
5,911,504 A * 6/1999 Schindlegger, Jr. .... A47J 43/04 366/197
6,012,837 A * 1/2000 Thuma ..... A47J 43/0722 366/294
D423,872 S * 5/2000 Blaise ..... D7/378
6,200,015 B1 * 3/2001 Gartz ..... A47J 43/1018 366/256
6,390,665 B1 * 5/2002 Silveria ..... A47J 43/0716 366/307
D488,956 S * 4/2004 Boyle ..... B01F 7/00583 D7/412
6,719,451 B1 * 4/2004 Yue ..... A47J 43/27 366/130
6,796,705 B1 * 9/2004 Khubani ..... A47J 43/046 366/197
D499,603 S * 12/2004 Nikkhah ..... D7/378
6,962,432 B2 * 11/2005 Hofeldt ..... A47J 43/042 215/309
D548,523 S * 8/2007 Greenspon ..... D7/507
7,364,348 B1 * 4/2008 Jones ..... A47J 43/042 366/130
7,371,004 B1 * 5/2008 Branson ..... A47J 43/046 366/130
7,384,182 B2 * 6/2008 Bhavnani ..... A47J 43/046 366/130
7,878,701 B2 * 2/2011 Stephens ..... A47J 27/004 366/145
8,157,435 B2 * 4/2012 Pryor, Jr. ..... A47J 43/0727 241/282.1
D696,071 S * 12/2013 Hammad ..... D7/376
9,314,126 B2 * 4/2016 Molayem ..... A47G 19/2288
2001/0002891 A1 * 6/2001 Frankel ..... A47J 43/0716 366/146
2001/0036124 A1 * 11/2001 Rubenstein ..... A47G 19/2205 366/205
2005/0105387 A1 * 5/2005 Nikkhah ..... A47J 43/042 366/205
2006/0198241 A1 * 9/2006 Krishnachaitanya ..... A47J 43/046 366/205
2008/0217284 A1 * 9/2008 Roth ..... B65D 47/268 215/229
2011/0024537 A1 * 2/2011 Gonzalez ..... A47J 43/046 241/101.2
2011/0041704 A1 * 2/2011 Feierabend ..... A47J 43/0465 99/323.1
2011/0192845 A1 * 8/2011 Swartz ..... A47G 19/2205 220/212
2012/0092953 A1 * 4/2012 Fung ..... A23G 9/22 366/343
2013/0010568 A1 * 1/2013 Bodum ..... A47J 31/00 366/130
2015/0283037 A1 * 10/2015 Trejo ..... A61J 9/00 215/11.1
2016/0107808 A1 * 4/2016 Forsyth ..... A47G 19/2272 220/592.17
2016/0130052 A1 * 5/2016 Stenglein ..... A47J 43/0727 220/212
2016/0150914 A1 * 6/2016 Waggoner ..... A47J 43/27 366/130
2016/0318693 A1 * 11/2016 Hein ..... B65D 41/0442
2016/0354740 A1 * 12/2016 Gonzalez ..... A61J 9/0623
2016/0354741 A1 * 12/2016 Santiago ..... B01F 7/00583
2017/0274332 A1 * 9/2017 Gandhi ..... B01F 7/00141

* cited by examiner

POWER SHAKER BLENDER

BACKGROUND OF THE INVENTION

Technical Field of the Invention

The present invention relates generally to blenders and, more specifically, to a lightweight rechargeable portable plastic blender that may be attached to a belt, back-pack, or other item. The blender includes a swivel opening for the cap and additionally provides a cylindrical mixing blade configuration that creates multiple vortices within the mixing body or chamber and that also includes volume markings on the exterior of the chamber.

Description of the Prior Art

There are other portable blenders designed for utility and ease of transportation. While these blenders may be suitable for the purposes for which they where designed, they would not be as suitable for the purposes of the present invention as herein described. It is thus desirable to provide a portable shaker/blender that is rechargeable and easily attached proximate the user's person. It is further desirable to provide a shaker/blender that allows the user to easily blend the desired material by means of the unique and powerful mixing blades disposed within the blender/shaker body.

SUMMARY OF THE INVENTION

It is therefore an object of the present invention is to provide a portable power shaker blender that is rechargeable and lightweight.

Another object of the present invention is to provide a portable power shaker blender that includes a latching carabiner or the like for allowing the user to attach the blender to their person.

Yet another object of the present invention is to provide a portable power shaker blender that includes a swiveling top for adding material into the blender body.

Still yet another object of the present invention is to provide a portable power shaker blender where a diagonally disposed blending mixing blade creates multiple vortices in the blending chamber.

Another object of the present invention is to provide a portable power shaker blender with a substantially transparent mixing chamber to allow the user to determine the progress of the blending or shaking of the desired material.

Yet another object of the present invention is to provide a portable power shaker blender having volume measurement markings on the transparent mixing body chamber.

Still yet another object of the present invention is to provide a portable power shaker blender having a standard rechargeable input plug for ease of powering the unit.

The foregoing and related objects are accomplished by the present invention, which provides a portable blender or shaker for agitating and dispensing liquids and semi-liquids, which includes a main mixing body having an interior, a first top open end and a second closed bottom mixing blade end where the mixing blade end comprises a mixing blade assembly extending into said interior of said main mixing body. A cap, including a swivel top portion and a swivel top handle is further provided, with the cap having a mixing body engagement that engages the mixing body at the first top open end. The base portion preferably includes a battery, a motor, an activation switch and a recharging input, wherein the mixing blade assembly comprises a central vertical shaft extending upwards into the interior of the main mixing body with a pair of horizontally disposed crossbars attached thereto and extending outwardly from to define a pair of crossbar ends and in which the mixing blade assembly further comprises a pair of vertical bars connecting the horizontally disposed crossbars at each of the crossbar ends and wherein an additional diagonal bar extends from one to another of the corners formed by the connected horizontally disposed crossbars and that vertical bars, so that when the motor is activated, the vertical, horizontal and diagonal bars extending from the central shaft rotate thereabout, thus agitating material located within the interior of the mixing body.

Other objects and features of the present invention will become apparent when considered in combination with the accompanying drawing figures, which illustrate certain preferred embodiments of the present invention. It should, however, be noted that the accompanying drawing figures are intended to illustrate only select preferred embodiments of the claimed invention and are not intended as a means for defining the limits and scope of the invention.

BRIEF DESCRIPTION OF THE DRAWING FIGURES

In the drawing, wherein similar reference numerals and symbols denote similar features throughout the several views.

DESCRIPTION OF THE REFERENCED NUMERALS

Figure 1:
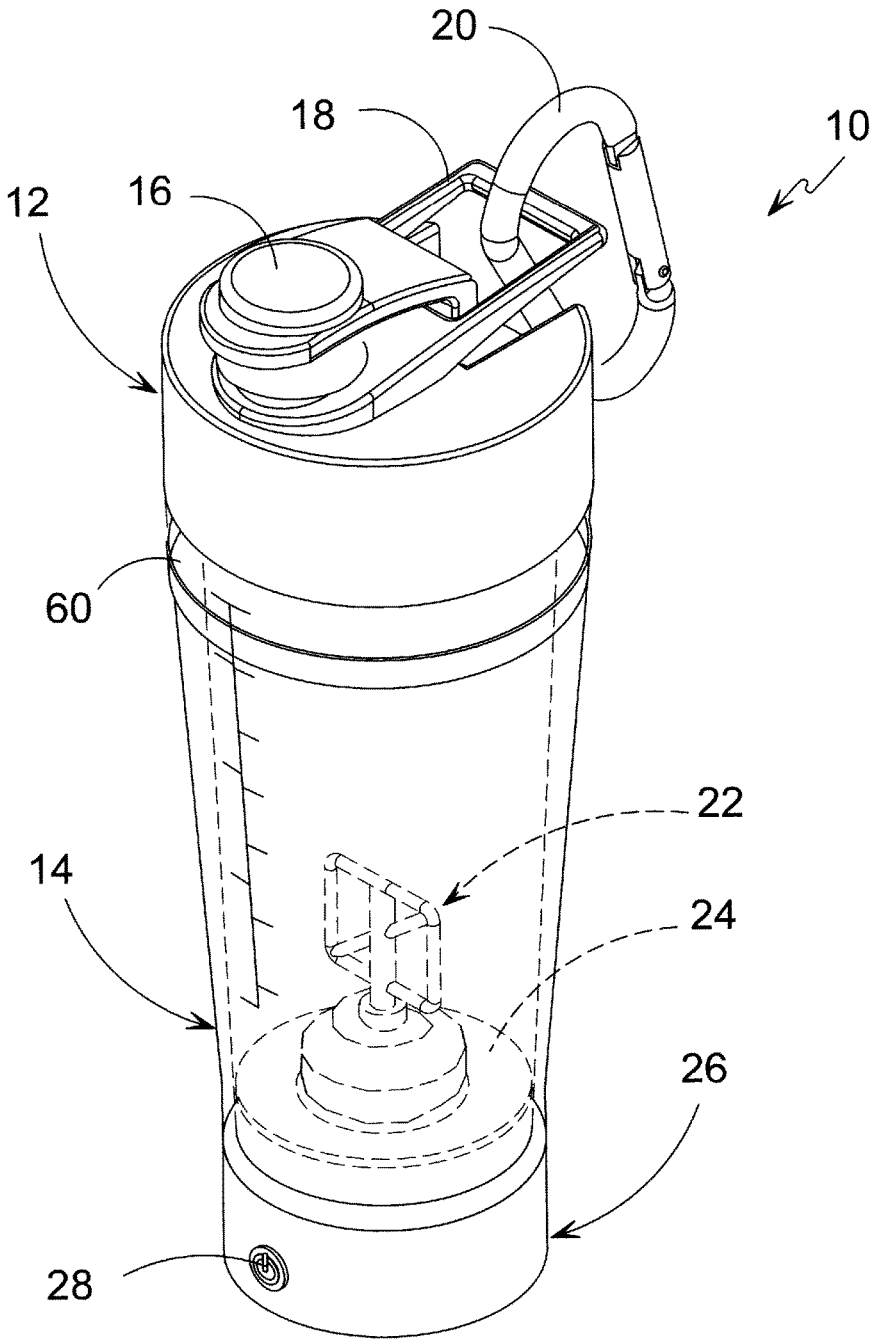
FIG. 1 is a perspective view of the portable blender of the present invention.

Turning now descriptively to the drawings, in which similar reference characters denote similar elements throughout the several views, the figures illustrate the use of the present invention. With regard to the reference numerals used, the following numbering is used throughout the various drawing figures:

10 power/shaker blender
12 cap
14 mixing body
16 swivel top
18 swivel top handle
20 latching carabiner
22 mixing blade assembly
24 mixing blade base
26 base/power unit
28 recharger input
30 battery

32 mixing blade central shaft
34 mixing blade vertical bars
36 mixing blade horizontally disposed crossbars
38 mixing blade cylindrical diagonal bar
40 volume measurement indicia
42 liquid
44 material to be mixed
46 power switch
48 mixing blade rotational arrow
50 mixed material
52 smooth material flow
54 chaotic material flow
56 cylindrical blade cross-section
58 motor
A2 additional vortices
A1 blade assembly directional arrow
60 mixing body and cap fit engagement

DETAILED DESCRIPTION OF THE DRAWING FIGURES AND PREFERRED EMBODIMENTS

The invention will now be described, by way of example only, with reference to the accompanying drawings:

Turning now, in detail, to an analysis of the drawing figures, referring to FIG. 1, shown is the portable power shaker blender indicated at 10. The shaker blender 10 includes a cap 12, a mixing body 14, a swivel top 16 with a swivel top handle 18 and a latching carabiner 20. Also shown in FIG. 1 are the mixing blades 22, the mixing blade base 24, the power unit and body base 26 and the recharging input 28.

As further seen in FIG. 1, the cap 12 also includes a swivel top 16, with a swivel top handle 18. The swivel top 16 is such that the user may either easily pour or drink from the blender 10 as desired. The swivel top handle 18 is, preferably, a generally U-shaped object and is adapted so that a latching carabiner 20, or similar like object is able to be clipped to it, or through it, to allow the user to attach and detach the power shaker blender 10 at will from either their person or an object.

Figure 2:
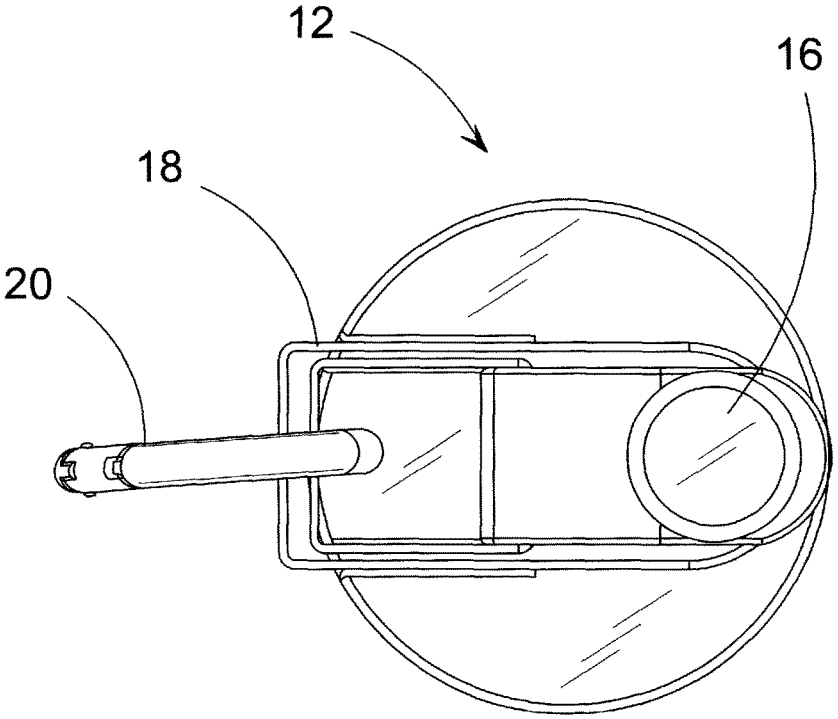
FIG. 2 is a top view of the portable blender of the present invention.

In FIG. 2, a top view of the cap 12 is shown, along with the swivel top 16 and the latching carabiner 20, as will be further discussed in detail below.

Figure 3:
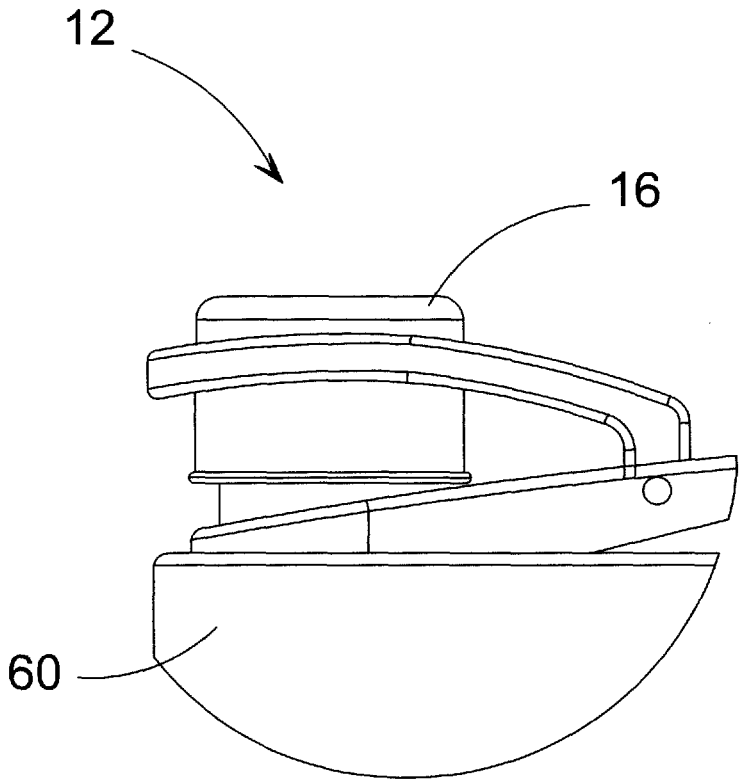
FIG. 3 is a side view of the pivoting cap of the portable blender of the present invention.

FIG. 3 is a side view of the cap 12 with swivel top 16.

Figure 4:
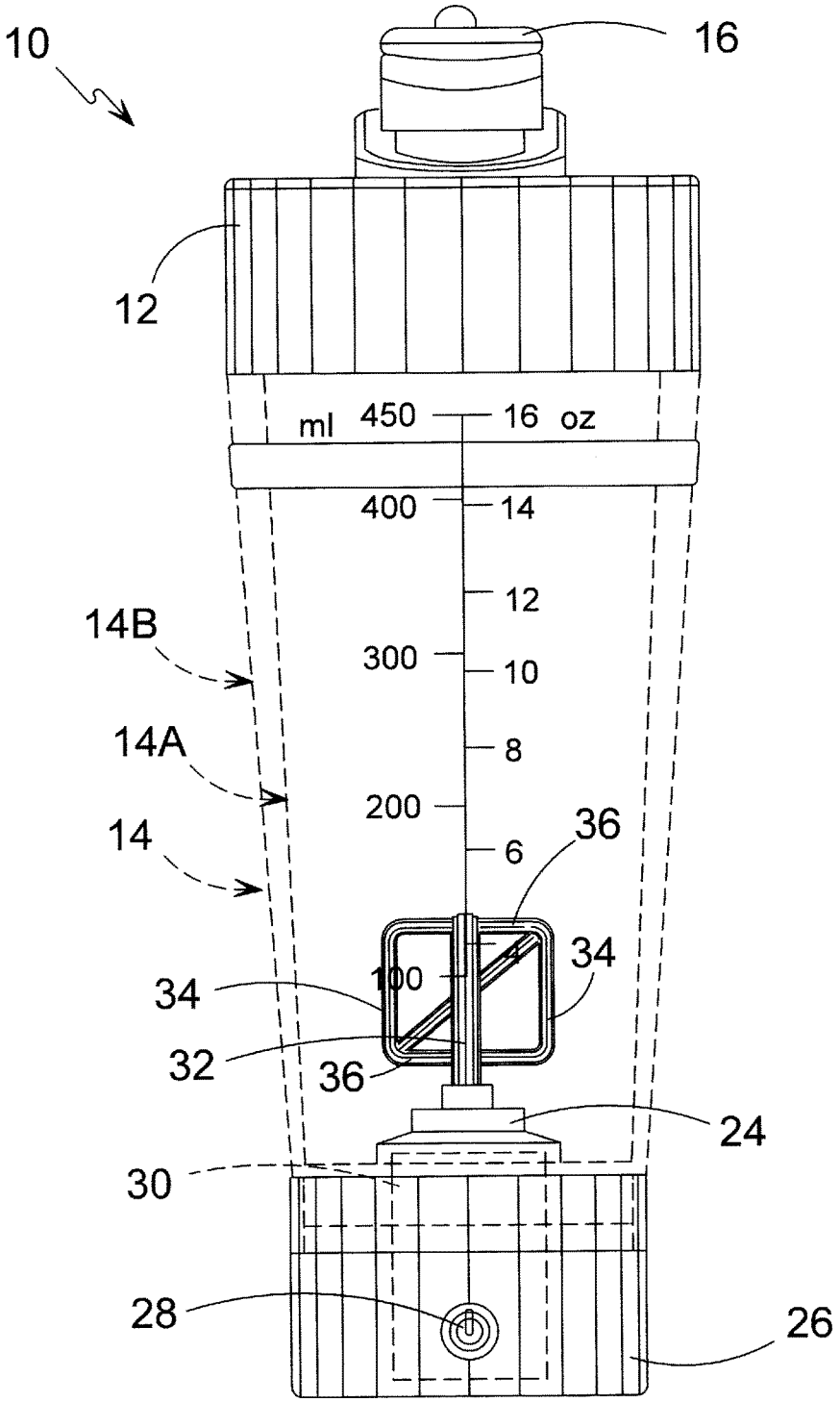
FIG. 4 is a front view of the portable blender of the present invention showing the mixing blade disposition and the volume markings on the mixing body.

FIG. 4 presents a front view of the present invention 10 with the cap 16 having a swivel top. The central mixing body 14 has an inner wall 14*a* and an outer wall 14*b* and is, in the preferred embodiment described herein, transparent. Contained within the central mixing body 14 is the mixing blade 22 and the mixing blade base 24. These connect with the power unit/base 26 with its contained battery 30. The mixing blade 26 is made up of a central shaft 32, a pair of horizontally disposed crossbars 36 connected at their ends by vertical bars 34. Extending diagonally between opposing corners of these members 34, 36 is a cylindrical diagonal bar 38. As this mixing blade assembly 22 rotates as described below, any miscible amount of liquid contained within the mixing body 14 will be affected; also note the volume measurement indicia 40 inscribed on the mixing body.

Figure 5:
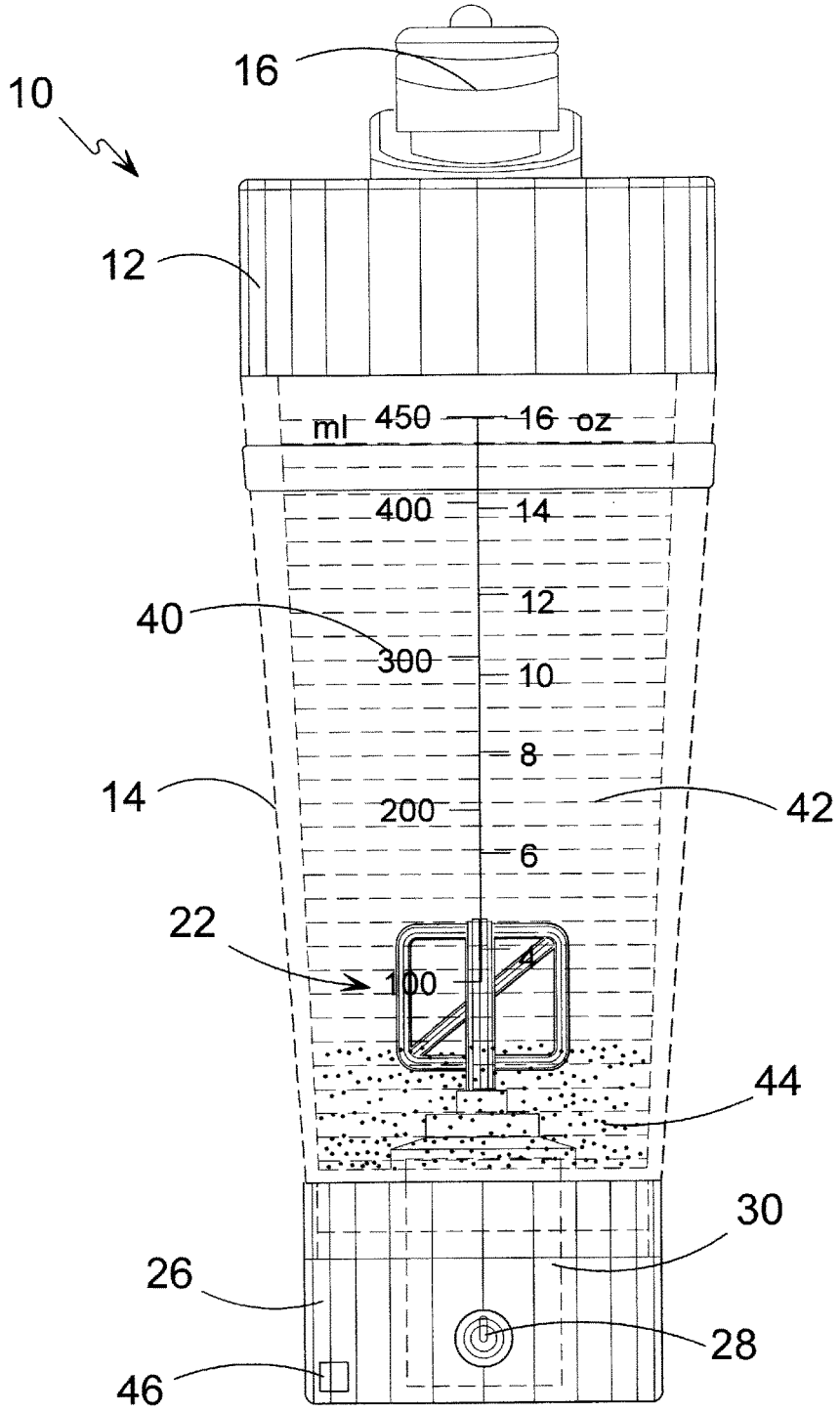
FIG. 5 is another front view of the portable blender of the present invention showing material in the blending chamber.

In FIG. 5, the shaker blender 10 is seen with liquid 42 substantially filling the interior of the mixing body 14. Material to be mixed with the liquid (indicated at 44) is seen at the bottom of the mixing body 14 proximate the blade assembly 22. When the power switch 46 is activated, the mixing blade assembly 22 rotates as will be seen in FIG. 6 where the direction of rotation is indicated by reference numeral 48. The material 44 and liquid 42 are commingled as indicated by reference numeral 50.

Figure 6:
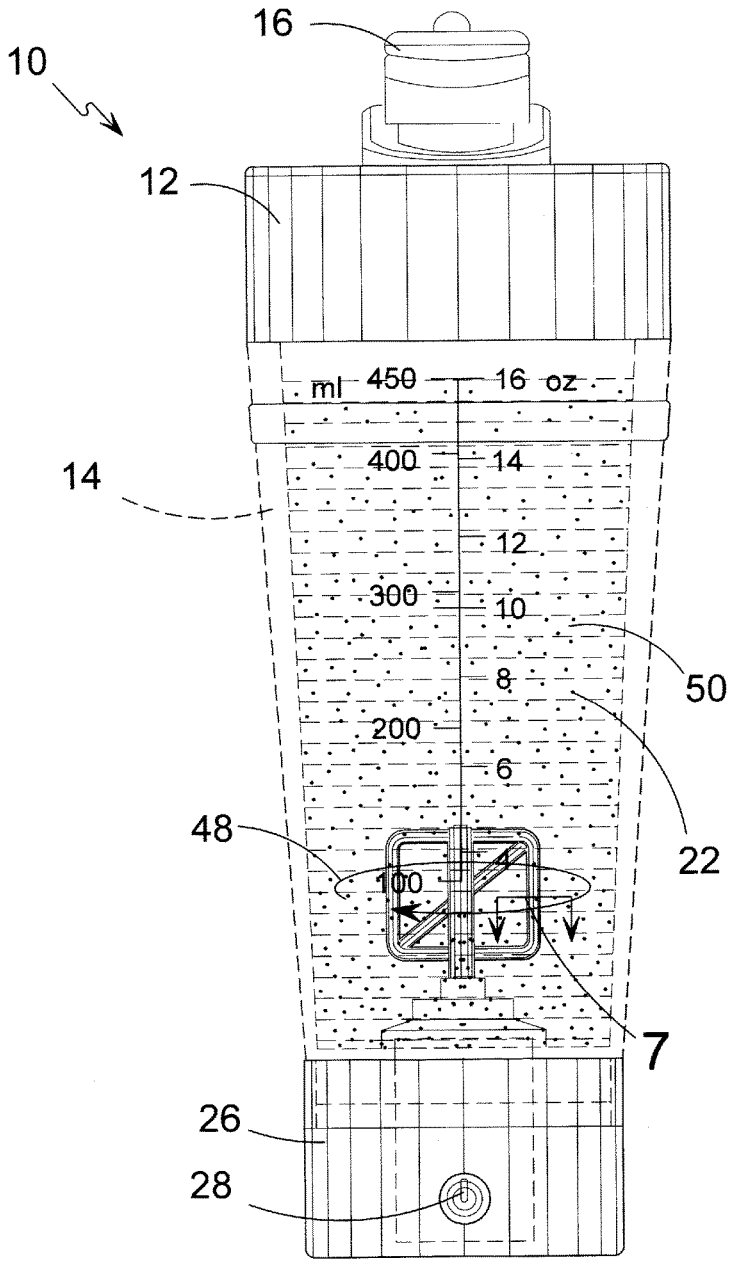
FIG. 6 is a plan view of the portable blender of the present invention in use.
Figure 7:
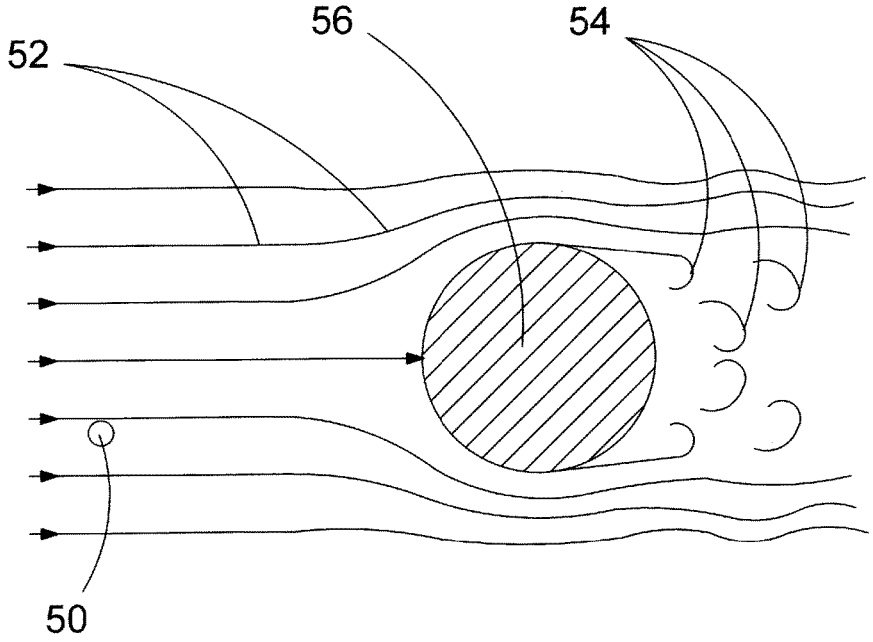
FIG. 7 is a cross-sectional view taken along line 7-7 in FIG. 6 of the shaped-blade portion of the portable blender of the present invention in use; and, FIG. 8 is a plan view of the mixing blade assembly of the portable blender of the present invention.

In FIG. 7, as taken along the 7-7 line of FIG. 6, the cylindrical blade cross-section 56 can be seen. As the liquid/material 50 flows past it as seen, the smoother flow 52 is formed into more chaotic flow areas 54 with multiple and multi-directional vortices. These assist in mixing the desired materials together more quickly. The cross-sectional shape shown in FIG. 7, it should be noted, applies to most, if not all, of the members that make up the horizontally disposed crossbars 36, the vertical bars 34, and the diagonal bar 38 in the embodiment of the invention described herein.

Figure 8:
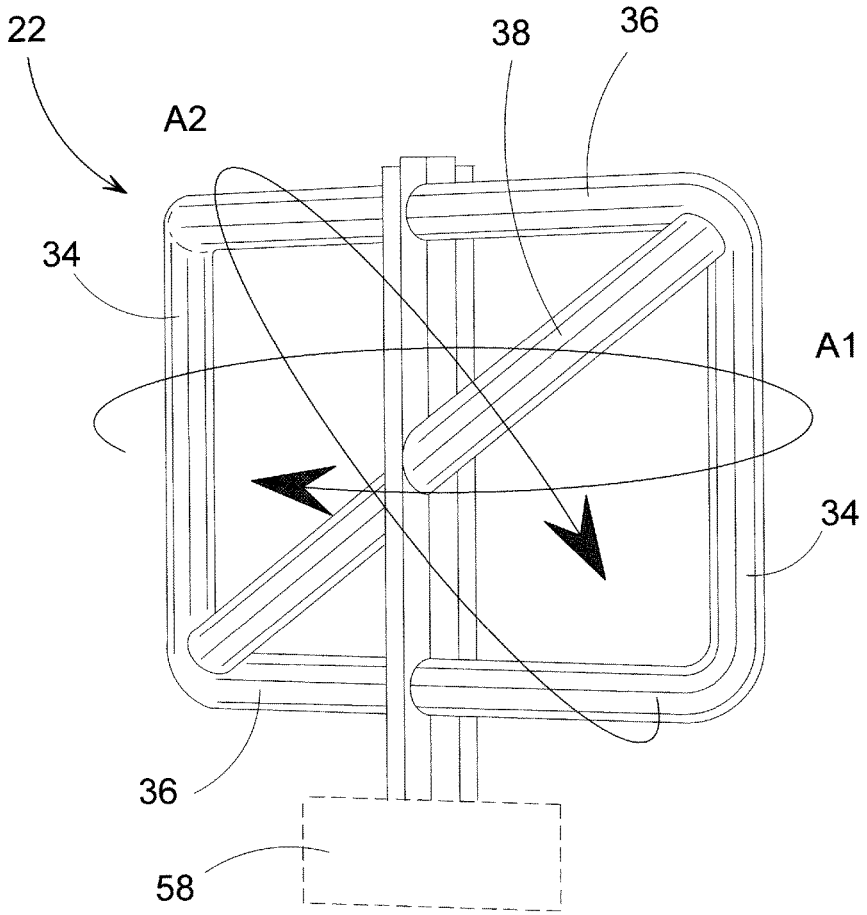

Turning to FIG. 8, the blade assembly 22 is shown as including a central shaft 32, a pair of horizontally disposed crossbars 36 connected with a corresponding pair of vertical bars 34, and a cylindrical diagonal bar 38 extending between opposing corners. When the motor, denoted by reference numeral 58, is activated by power switch 46 (as seen in previous drawing figures), the blade assembly 22 rotates, as shown generally by directional arrow A1 in FIG. 8. By virtue of the breakup in the flow of liquid around the cylindrical cross-section of the blade as seen at 54 and 56 in FIG. 7, additional vortices in multiple directions are formed as shown at A2.

The present invention presents a simple and easy way to carry a tool that allows the user to blend and/or pulverize material while in a remote area or otherwise in an area without standard outlet power. The power shaker blender 10 is preferably made from lightweight food-safe material, such as, for example, a high-density polyethylene, such as Nalgene (registered trademark of Nalge Nunc International Corporation, Rochester, N.Y.) or other clear durable materials. The power could be provided, for example, by a rechargeable battery 30 with an adapter inlet 28 that would fit standardized plugs. The battery 30 powers an electric motor 58 to spin the blade assembly 22, as seen in FIG. 8.

The power shaker 10 mixer body is preferably hollow and includes the mixing blade assembly 22 and the mixing blade base assembly 24. These would be conceivably detachable for cleaning. The mixing body 14 could be either transparent, opaque or a combination of the two. It is contemplated that volume measurement indicia 40 would be imprinted or otherwise inscribed on the body 14. The cap 12 has a mixing body cap fit portion 60 (as best seen in FIG. 3) that engages the open top of the mixing body 14. This mixing body cap fit engagement portion could also be a screw cap type engagement as is implied by the other drawing figures.

The present invention as described will be of use in various applications, such as recreational uses, and potential uses in field medicine and in the sciences, such as archaeology, geology and environmental science, While only several embodiments of the present invention have been shown and described, it will be obvious to those skilled in the art that many modifications may be made to the present invention without departing from the spirit and scope thereof.

What is claimed is:

1. A portable blender/shaker for agitating and dispensing liquids and semi-liquids, comprising:

a main mixing body having an interior, a first top open end and a second closed bottom mixing blade end where said mixing blade end includes a mixing blade assembly extending into said interior of said main mixing body;

a cap including a swivel top portion and a swivel top handle, said cap further including a mixing body engagement that engages said mixing body at said first top open end;

a base portion including a battery, a motor, an activation switch, and a recharging input; and wherein said mixing blade assembly comprises a central vertical shaft extending upwards into said interior of said main mixing body with a pair of horizontally disposed crossbars attached thereto and extending outwardly from to define a pair of crossbar ends and where said mixing blade assembly further comprises a pair of vertical bars connecting said horizontally disposed crossbars at each of said crossbar ends and where an additional diagonal bar extends from one to another of the corners formed by said connected horizontally disposed crossbars and said vertical bars, so that when said motor is activated, said vertical, horizontal, and diagonal bars extending from said central shaft rotate thereabout thus agitating material located within said interior of said mixing body.

2. The portable blender/shaker for agitating and dispensing liquids and semi-liquids according to claim 1, wherein said swivel top handle on said cap is an open U-shaped member adapted to receive an attaching engagement.

3. The portable blender/shaker for agitating and dispensing liquids and semi-liquids according to claim 2, wherein the attaching engagement is a latching carabiner.

4. The portable blender/shaker for agitating and dispensing liquids and semi-liquids according to claim 3, wherein said mixing body engagement on said cap is a friction fit.

5. The portable blender/shaker for agitating and dispensing liquids and semi-liquids according to claim 4, wherein said horizontally disposed crossbars, said vertical bars, and said diagonal bar are all cylindrical in cross-section, thus increasing chaotic type vortices in the agitated material.

6. The portable blender/shaker for agitating and dispensing liquids and semi-liquids according to claim 5, wherein said main mixing body is made of polyethylene.

7. The portable blender/shaker for agitating and dispensing liquids and semi-liquids according to claim 6, wherein said main mixing body further includes volume measurement indicia.

8. The portable blender/shaker for agitating and dispensing liquids and semi-liquids according to claim 3, wherein said mixing body engagement on said cap is a screw top engagement.

9. The portable blender/shaker for agitating and dispensing liquids and semi-liquids according to claim 8, wherein said horizontally disposed crossbars, said vertical bars, and said diagonal bar are all cylindrical in cross-section, thus increasing chaotic type vortices in the agitated material.

10. The portable blender/shaker for agitating and dispensing liquids and semi-liquids according to claim 9, wherein said main mixing body is made of polyethylene.

11. The portable blender/shaker for agitating and dispensing liquids and semi-liquids according to claim 10, wherein said main mixing body further includes volume measurement indicia.

12. The portable blender/shaker for agitating and dispensing liquids and semi-liquids according to claim 1, wherein said horizontally disposed crossbars, said vertical bars and said diagonal bar are all cylindrical in cross-section, thus increasing chaotic type vortices in the agitated material.

13. The portable blender/shaker for agitating and dispensing liquids and semi-liquids according to claim 12, wherein said main mixing body is made of polyethylene.

14. The portable blender/shaker for agitating and dispensing liquids and semi-liquids according to claim 13, wherein said main mixing body further includes volume measurement indicia.

* * * * *